US009451790B2

(12) United States Patent
Liu

(10) Patent No.: US 9,451,790 B2
(45) Date of Patent: Sep. 27, 2016

(54) ELECTRONIC CIGARETTE ATOMIZER AND ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 507 days.

(21) Appl. No.: 13/855,052

(22) Filed: Apr. 2, 2013

(65) Prior Publication Data

US 2014/0202475 A1 Jul. 24, 2014

(30) Foreign Application Priority Data

Jan. 24, 2013 (CN) ..... 2013 2 0039603 U

(51) Int. Cl.
*A24F 47/00* (2006.01)

(52) U.S. Cl.
CPC ..... *A24F 47/008* (2013.01)

(58) Field of Classification Search
CPC ..... A24F 47/002–47/008
USPC ..... 131/270, 273, 194, 329; 128/202.21
See application file for complete search history.

(56) References Cited

U.S. PATENT DOCUMENTS 4,714,082 A * 12/1987 Banerjee ..... A24B 15/165 131/335
5,665,262 A * 9/1997 Hajaligol et al. ..... 219/553
2009/0032344 A1* 2/2009 Thompson ..... F16D 65/128 188/264 D
2009/0151717 A1* 6/2009 Bowen ..... A61M 11/041 128/200.23
2010/0242974 A1* 9/2010 Pan ..... 131/273
2011/0005535 A1* 1/2011 Xiu ..... 131/273
2011/0303231 A1* 12/2011 Li et al. ..... 131/329
2012/0285475 A1* 11/2012 Liu ..... A24F 47/008 131/329
2013/0160764 A1* 6/2013 Liu ..... 128/202.21
2013/0319436 A1* 12/2013 Liu ..... 131/329
2013/0340779 A1* 12/2013 Liu ..... 131/329
2014/0130816 A1* 5/2014 Liu ..... 131/329
2014/0332017 A1* 11/2014 Liu ..... 131/329
2014/0338684 A1* 11/2014 Liu ..... 131/329

* cited by examiner

*Primary Examiner* — Michael H Wilson
*Assistant Examiner* — Yana B Krinker
(74) *Attorney, Agent, or Firm* — Tim Tingkang Xia, Esq.; Locke Lord LLP

(57) ABSTRACT

An electronic cigarette atomizer is provided, comprising a suction nozzle cover, a fiberglass pipe sleeved on the suction nozzle cover, an oil cotton covered by the fiberglass pipe and a shell covered by the oil cotton, wherein, it also comprises multiple heat insulating layers and a connector far away from one end of the suction nozzle cover, the multiple heat insulating layers are sleeved on the outside of the oil cotton successively and located between the oil cotton and the shell, one end of the multiple insulating layers is butting connected with the connector inserted into the shell, the other end of the multiple insulating layers is butting connected with the suction nozzle cover inserted into the shell. It can effectively solve the problem that the electronic cigarette may run hot after been used continuously for a long time and improve the taste of smoking through using multiple insulating layers.

5 Claims, 4 Drawing Sheets

ELECTRONIC CIGARETTE ATOMIZER AND ELECTRONIC CIGARETTE

CROSS-REFERENCE TO RELATED APPLICATIONS

This non-provisional application claims priority under 35 U.S.C. §119(a) on Patent Application No. 201320039603.3 filed in P.R. China on Jan. 24, 2013, the entire contents of which are hereby incorporated by reference.

FIELD OF THE INVENTION

The present invention relates to the field of consumer electronic products technology, more particularly, to an electronic cigarette atomizer and an electronic cigarette comprising the electronic cigarette atomizer.

BACKGROUND OF THE INVENTION

The electronic cigarette substituted for traditional tobacco has been used widely due to the strengthening of anti-smoking publicity and the improvement of health consciousness. The existing electronic cigarette consists of a cigarette rod and a cigarette holder, the cigarette rod is provided with a battery, the cigarette holder is equipped with an atomizer, the atomizer is electrically connected to the cigarette rod. The cigarette holder is provided with a oil cup for holding tobacco juice, the tobacco juice slowly flows into the atomizer when user begins to smoke with the cigarette holder. The atomization silk of the atomizer imbibes the tobacco juice, the control circuit of the cigarette rod senses the current, the tobacco juice is atomized by the heating device of the atomization silk and the smog is formed to be inhalant.

When the atomization silk of the atomizer gives off heat and atomizes the tobacco juice, the heat will be transmitted to the external of the electronic cigarette. The existing heat-insulating protections of the external of the electronic cigarette is less, generally having a protective sleeve or a protective sleeve and a layer of sticker, the protective sleeve is hot and may be burn the user if he has smoked for a long time.

SUMMARY OF THE INVENTION

The objective of the present invention is to provide an electronic cigarette atomizer and an electronic cigarette which can effectively solve the problem that the existing electronic cigarette may run hot after been used continuously for a long time and improve the taste of smoking through using multiple heat insulating layers.

The technical solutions of the present invention for solving the technical problems are as follows:

On one hand, an electronic cigarette atomizer is provided, which comprises a suction nozzle cover, a fiberglass pipe sleeved on the suction nozzle cover, an oil cotton covered by the fiberglass pipe and a shell covered by the oil cotton, wherein, it also comprises multiple heat insulating layers and a connector far away from one end of the suction nozzle cover, the multiple heat insulating layers are sleeved on the outside of the oil cotton successively and located between the oil cotton and the shell, one end of the multiple insulating layers is abutted against the connector inserted into the shell, the other end of the multiple heat insulating layers is butting connected with the suction nozzle cover inserted into the shell.

Advantageously, the electronic cigarette atomizer also comprises a sticker sleeve, the sticker sleeve is attached to the outer surface of an outermost layer of the multiple heat insulating layers.

Advantageously, the fiberglass pipe, the oil cotton, the multiple heat insulating layers and the sticker sleeve have a same axis.

Advantageously, a gap is provided between two adjacent layers of the multiple heat insulating layers.

Advantageously, the multiple heat insulating layers are made of metal, ceramic, plastic, wood or paper material.

Advantageously, the connector comprises a thread portion and an engagement portion, the thread portion and the engagement portion are integrally formed.

Advantageously, the thread portion is cylindrical, the external of the thread portion is provided with whorls; the section of the engagement portion is a stair-stepping cylinder, the engagement portion comprises an upper cover, an engagement portion body and an extending portion extended along the bottom end of the engagement portion body.

Advantageously, the multiple heat insulating layers comprise an inner heat insulating layer and an outer heat insulating layer, the inner heat insulating layer is butting connected with the extending portion, and the outer heat insulating layer is butting connected with the upper cover.

Advantageously, the multiple heat insulating layers also comprise a middle heat insulating layer, the middle heat insulating layer is set between the engagement portion body and the extending portion.

On the other hand, an electronic cigarette is provided, which comprises an electronic cigarette holder, an electronic cigarette rod sleeved on one end of the cigarette holder and a lamp cap located on one end of the cigarette rod, the electronic cigarette atomizer described above is provided inside the electronic cigarette holder.

When implementing the electronic cigarette atomizer and the electronic cigarette of the present invention, the following advantageous effects can be achieved. Since the surface of the electronic cigarette atomizer is covered with the multiple heat insulating layers for heat insulation, it can effectively solve the problem that the existing electronic cigarette may run hot after been used continuously for a long time and improve the taste of smoking through using multiple heat insulating layers.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical features, objectives and effects of the present invention be understood more clearly, the specific implementations of the present invention will be described in detail with reference to the accompanying drawings and embodiments.

Figure 1:
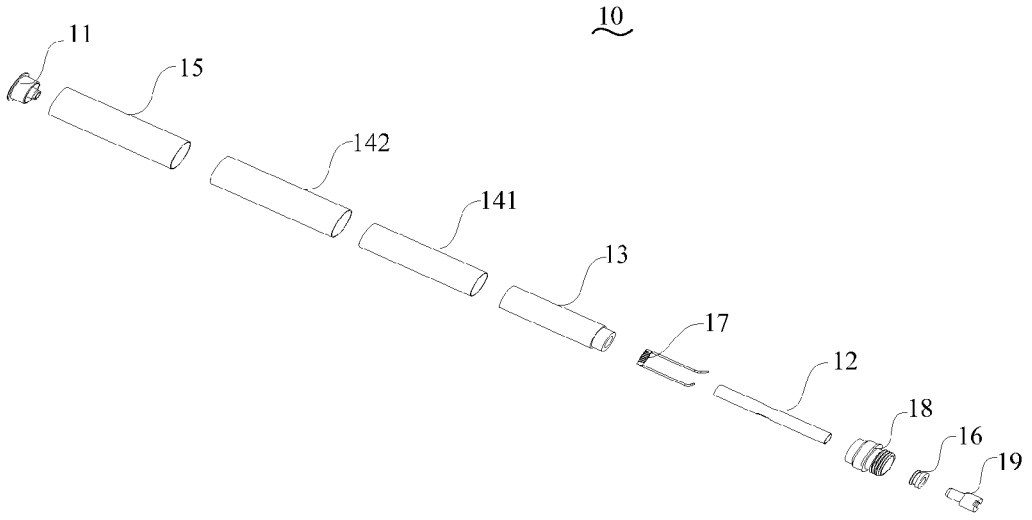
FIG. 1 is an explosive view of an electronic cigarette atomizer according to an embodiment of the present invention.
Figure 2:
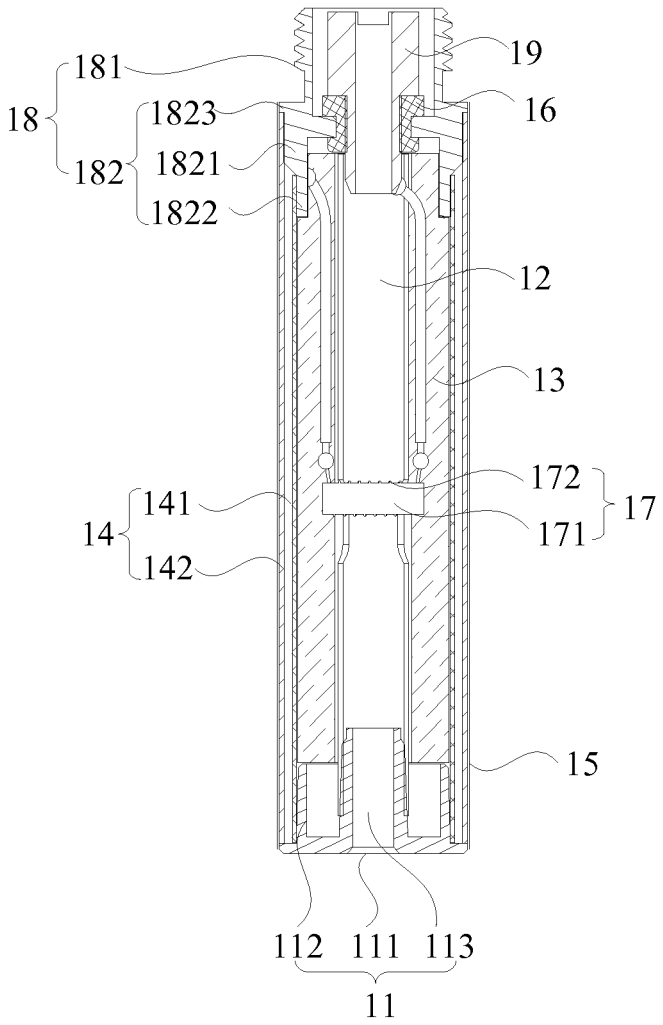
FIG. 2 is a sectional view of an electronic cigarette atomizer according to an embodiment of the present invention.

Referring to FIGS. 1 and 2, the electronic cigarette atomizer 10 of the present invention comprises a suction nozzle cover 11 located in a shell (i.e. element 142), a fiberglass pipe 12 with a through hole, an oil cotton 13, multiple heat insulating layers 14, a sticker sleeve 15, a atomization component 17, a connector 18, a top electrode 19 and an insulating ring 16. The fiberglass pipe 12 is sleeved on the suction nozzle cover 11, the outside of the fiberglass pipe 12 is covered with the oil cotton 13, the multiple heat insulating layers 14 and the sticker sleeve 15 successively, and the fiberglass pipe 12, the oil cotton 13, the multiple insulating layers 14 and sticker sleeve 15 have a same axis. The multiple heat insulating layers 14 are covered outside the electronic cigarette atomizer 10 for heat insulation, enabling to effectively solve the problem of burning when the electronic cigarette has been smoked for a long time.

The suction nozzle cover 11 is around cylindrical, and is inserted in the sticker sleeve 15. The suction nozzle cover 11 comprises a base 111, a body 112 and a through hole 113. The body 112 is hollow cylinder, and vertically set in the base 111. The through hole 113 is sleeved on the inside of the body 112 and spaced from both sides of the body 112, so a surrounding space is formed between the body 112 and the through hole 113 for holding tobacco juice. One end part of the multiple heat insulating layers 14 is butting connected with the base 111 and outside of the body 112, thus the atomizer is sealed.

A gap is provided between two adjacent layers of the multiple insulating layers. As shown in FIG. 2, the multiple heat insulating layers 14 comprise an inner heat insulating layer 141 and an outer heat insulating layer 142, a gap is provided between the inner heat insulating layer 141 and the outer heat insulating layer 142, so the heat produced after the tobacco juice has been atomized by the atomization component 17 will not pass from the inner heat insulating layer 141 to the outer heat insulating layer 142 immediately, but will arrive the outer heat insulating layer 142 through the air in the gap. The temperature of the electronic cigarette atomizer 10 can be further decreased because the air is a poor conductor for heat, and it is no longer burning for the user.

The sticker sleeve 15 is attached to the outer surface of an outermost layer of the multiple heat insulating layers 14, it can further play a role in reducing the temperature. In other embodiments, other ways are used for heat insulation such as painting on the outer surface of the outermost layer of the multiple heat insulating layers.

The connector 18 is a cylinder far away from the suction nozzle cover 11 and embeds into the sticker sleeve 15. The connector 18 comprises a thread portion 181 and an engagement portion 182, the thread portion 181 and the engagement portion 182 are integrally formed.

The thread portion 181 is around cylindrical, the external of the thread portion 181 is provided with whorls, and the thread portion 181 is positioned in one end part of the connector 18. The thread portion 181 is connected with the cigarette rod (not shown) of the electronic cigarette, the other end of the thread portion 181 is sleeved on the engagement portion 182.

The section of engagement portion 182 is around stair-stepping cylinder, the engagement portion 182 is far away from the end where the thread portion 181 is located.

The engagement portion 182 comprises an upper cover 1823, an engagement portion body 1821 and an extending portion 1822 extended along the bottom end of the engagement portion body 1821. As shown in FIG. 2, when the multiple insulating layers 14 comprises two heat insulating layers: one is the inner heat insulating layer 141, the other is the outer heat insulating layer 142, the inner heat insulating layer 141 is butting connected with the extending portion 1822, the top end of the outer insulating layer 142 is butting connected with the upper cover 1823, the flank of the outer heat insulating layer 142 close to the top end is butting connected with the engagement portion body 1821.

In another embodiment, a middle heat insulating layer is provided between the inner heat insulating layer 141 and the outer heat insulating layer 142, the middle heat insulating layer can be one, two or more layers. The inner heat insulating layer 141 is butting connected with the extending portion 1822, the top end of the outer insulating layer 142 is butting connected with the upper cover 1823, the flank of the outer heat insulating layer 142 close to the top end is butting connected with the engagement portion body 1821, the middle heat insulating layer is set to between the engagement portion body 1821 and the extending portion 1822, so the whole atomizer is sealed.

The inside of the engagement portion body 1821 is provided with a flange, the shape of the flange is annular, the connector 18 is provided with a installation groove for mounting the top electrode 19, the top electrode 19 is set to the flange of the engagement portion body 1821 by using the insulating ring 16.

The atomization component 17 is inserted into the fiberglass pipe 12 through the through hole, and both ends of the atomization component 17 are placed outside of the fiberglass pipe 12. In the embodiment, the atomization component 17 comprises a fiber rope 171 and a heating wire 172, the heating wire 172 winds along the fiber rope 171, both ends of the heating wire 172 are connected with the wire (not shown), the part of the heating wire 172 winding along the fiber rope 171 is located inside the fiberglass pipe 12, and both ends of the fiber rope 171 extend from the internal to external of the fiberglass pipe 12. The fiber rope 171 is used to allow the tobacco juice pass to the heating wire 172, the tobacco juice is atomized when current has been afforded to the heating wire 172. The heating wire 172 is heated when the wire is energized, the fiber rope 171 continuously absorbs the tobacco juice of the oil cotton 13, meanwhile, the tobacco juice is atomized and the smog is generated.

The oil cotton 13 is made of lipophilic microfiber non-woven fabrics or other oil-absorbing fiber material, the oil cotton 13 does not contains chemical agents, cannot cause secondary pollution, and can attract grease, organic solvents, carbon hydrogen compound, vegetable oil ten times its own weight.

In a preferred embodiment, the fiber rope 171 comprises multiple fiberglass ropes set up in parallel, the heating wire 172 wires the multiple fiberglass ropes together and both ends of the fiber rope 171 is diffuse. The purpose of the diffuse shape is to increase the contact area of the fiber rope 171 and the oil cotton 13, and increase the oil absorption of the fiber rope 171, thereby the smog is increased and the taste of smoking is improved.

The electronic cigarette atomizer 10 of the present invention effectively solves the problem that the electronic cigarette will be burning after having been smoked for a long time because the surface of the electronic cigarette atomizer 10 is coated with the multiple heat insulating layers 14 for heat insulation.

Understandably, in other embodiments, the multiple heat insulating layers 14 cannot only cover the surface of the electronic cigarette atomizer 10, but also cover the shell surface of the whole electronic cigarette, then it can effectively solve the problem that the electronic cigarette will be burning after having been smoked for a long time.

Figure 3:
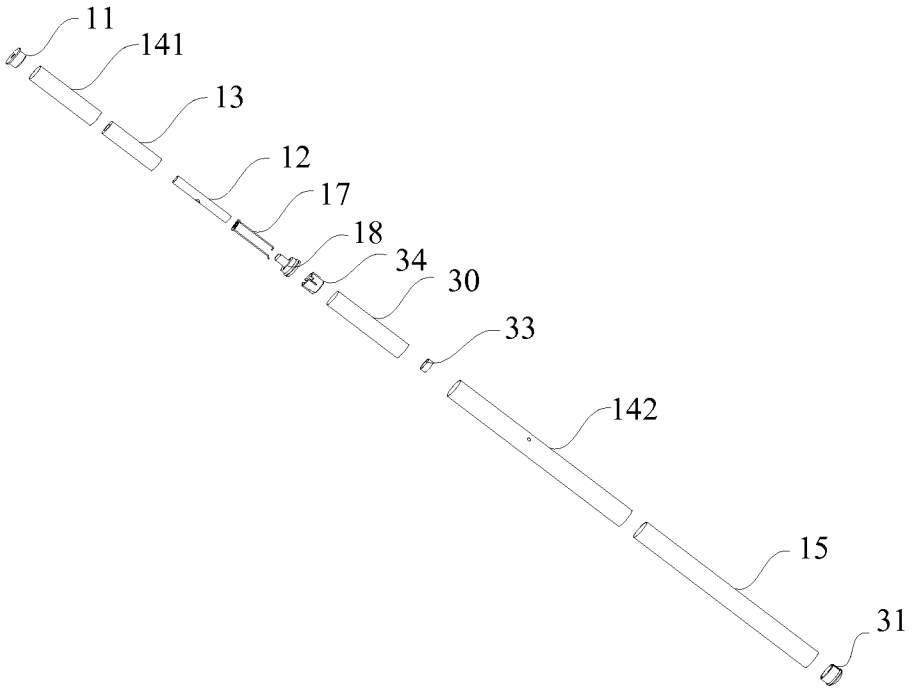
FIG. 3 is an explosive view of an electronic cigarette according to an embodiment of the present invention.
Figure 4:
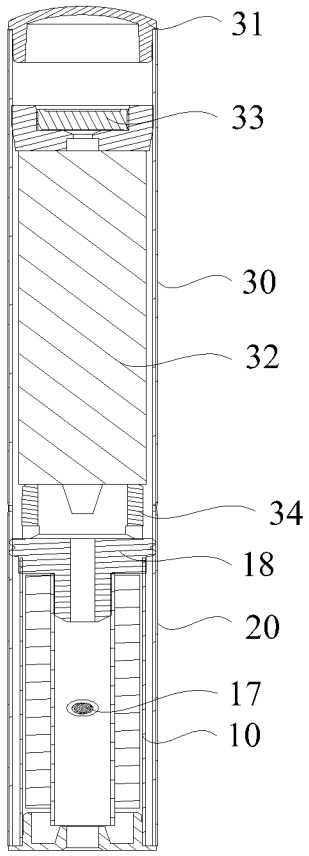
FIG. 4 is a sectional view of an electronic cigarette according to an embodiment of the present invention.

As shown in FIGS. 3 and 4, in another embodiment of the present invention, an electronic cigarette is provided, which comprises a cigarette holder 20, a cigarette rod 30 and a lamp cap 31 located at one end of the cigarette rod 30, and the above-mentioned electronic cigarette atomizer 10 is set in the cigarette holder 20, the structure of the electronic cigarette atomizer 10 is not described here.

To be sure, the cigarette rod 30 comprises a battery 32 and a LED lamp panel 33 electrically connected to the battery 32, the LED lamp panel 33 is located near one end of the lamp cap 31, the LED is facing towards the lamp cap 31. The battery 32 is used to heat the heating wire 172 of the atomization component 17, the tobacco juice attached to the heating wire 172 is atomized and smog is generated, thus, a smoking effect can be simulated.

The end of the cigarette rod 30 which close to the cigarette holder 20 is provided with a support 34, the external thread of the connector 18 of the atomizer 10 is threaded connected with the cigarette rod 30 through the support 34 when assembling the electronic cigarette.

The electronic cigarette of the embodiment using the above electronic cigarette atomizer 10 effectively solves the problem that the electronic cigarette will be burning after having been smoked for a long time because the surface of the electronic cigarette atomizer 10 is covered with the multiple heat insulating layers 14 for insulation.

While the present invention has been described with reference to preferred embodiments, it will be understood by those skilled in the art that various changes may be made and equivalents may be substituted without departing from the scope of the present invention. But all the changes will be included within the scope of the appended claims.

What is claimed is:

1. An electronic cigarette atomizer, comprising a suction nozzle cover arranged at one end of the electronic cigarette atomizer, a fiberglass pipe, an oil cotton covering the fiberglass pipe, multiple heat insulating layers sleeved on the oil cotton successively, and a connector arranged at the other end of the electronic cigarette atomizer;

wherein, the suction nozzle cover includes a tubular inner portion, a tubular outer portion coaxially arranged outside the inner portion, and a base arranged at a same side of the inner portion and the outer portion for enabling the inner portion and the outer portion to be connected together, and the inner portion, the outer portion and the base are integrally formed;

wherein, the connector comprises a thread portion and an engagement portion, and the thread portion and the engagement portion are integrally formed; the engagement portion is divided from top to bottom into an upper cover proximate the thread portion, an engagement portion body with an outer diameter less than that of the upper cover, and an extending portion with an outer diameter less than that of the engagement portion body; and the upper cover, the engagement portion body and the extending portion are integrally formed;

and wherein, the multiple heat insulating layers includes an inner heat insulating layer sleeved on the oil cotton, a middle heat insulating layer and an outer heat insulating layer sleeved; one end of the inner heat insulating layer is sleeved on the extending portion, and the other end of the inner heat insulating layer is on the outer portion of the suction nozzle cover and butting connected with the base of the suction nozzle cover; one end of the outer heat insulating layer is sleeved on the engagement portion body and butting connected with the upper cover, the other end of the outer heat insulating layer is butting connected with the base of the suction nozzle cover; the middle heat insulating layer set between the engagement portion body and the extending portion; the middle heat insulating layer has multiple layers.

2. The electronic cigarette atomizer according to claim 1, wherein, the electronic cigarette atomizer further comprises a sticker sleeve, the sticker sleeve is attached to the outer heat insulating layer of the multiple heat insulating layers.

3. The electronic cigarette atomizer according to claim 2, wherein, the fiberglass pipe, the oil cotton, the multiple heat insulating layers and the sticker sleeve have a same axis.

4. The electronic cigarette atomizer according to claim 1, wherein, the multiple heat insulating layers are made of metal, ceramic, plastic, wood or paper material.

5. An electronic cigarette, comprising an electronic cigarette holder, an electronic cigarette rod sleeved on one end of the cigarette holder, and a lamp cap located on one end of the cigarette rod;

wherein, an electronic cigarette atomizer as described in claim 1 is provided inside the electronic cigarette holder.

* * * * *